United States Patent [19]

Gambino

[11] 4,133,529

[45] Jan. 9, 1979

[54] GOLF GRIP

[76] Inventor: Joseph Gambino, 85 Cobata Ave., Copiague, N.Y. 11726

[21] Appl. No.: 820,881

[22] Filed: Aug. 1, 1977

[51] Int. Cl.[2] ..... A63B 53/14

[52] U.S. Cl. ..... 273/81 R; 273/75

[58] Field of Search ..... 273/72 R, 72 A, 73 J, 273/75, 81 R, 81.4–81.6; 145/61 R; 43/23; 74/551.8, 551.9, 558.5

[56] References Cited

U.S. PATENT DOCUMENTS

| | | | |
|---|---|---|---|
| 2,002,535 | 5/1935 | Gagnier | 273/81 R |
| 2,221,421 | 11/1940 | Curry | 273/81 R |
| 3,028,283 | 4/1962 | Lundgren et al. | 273/81 R X |
| 3,147,012 | 9/1964 | Sullivan | 273/75 X |
| 3,614,100 | 10/1971 | Spitz | 273/75 |

FOREIGN PATENT DOCUMENTS

| | | | |
|---|---|---|---|
| 466407 | 7/1950 | Canada | 273/81 R |
| 1142073 | 2/1969 | United Kingdom | 273/75 |

*Primary Examiner*—Richard J. Apley
*Attorney, Agent, or Firm*—Richard L. Miller

[57] ABSTRACT

A grip that fits around a golf club handle for giving a more comfortable and improved grasp thereof; the grip including a sleeve made of terrycloth, having a collar on one end, the collar having an adhesive or other securing means for holding firmly to the handles lower end, the top of the sleeve being closed.

4 Claims, 4 Drawing Figures

10

3
14
11
10
16
3

11
12
14
15
4
4
11

13
17
16
18
TERRY CLOTH
OPTIONAL
RUBBERIZED
INNER LINER
19

GOLF GRIP

This invention relates generally to golf club accessories. It is well known to golf players that in warmer weather their hands may perspire so that grasping the golf club handle is not only uncomfortable, but is also less secure during a swinging action. This is objectionable, and therefore, is in want of an improvement.

Accordingly, it is a principal object of the present invention to provide a golf grip for fitting around a handle of a golf club, and which overcomes the above mentioned situation by being of a material that absorbs moisture so as to eliminate perspiration from the surface of the golf club handle.

Another object is to provide a golf grip which gives a tighter frictional grasp than a smooth surface of a golf club handle wetted with perspiration or rain.

Still another object is to provide a golf grip which will prevent the hands from becoming perspired due to its natural feel when being held.

Yet a further object is to provide a golf grip which will outlast gloves many times longer, and which eliminates the discomfort of glove wear in hot or in humid weather.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4:
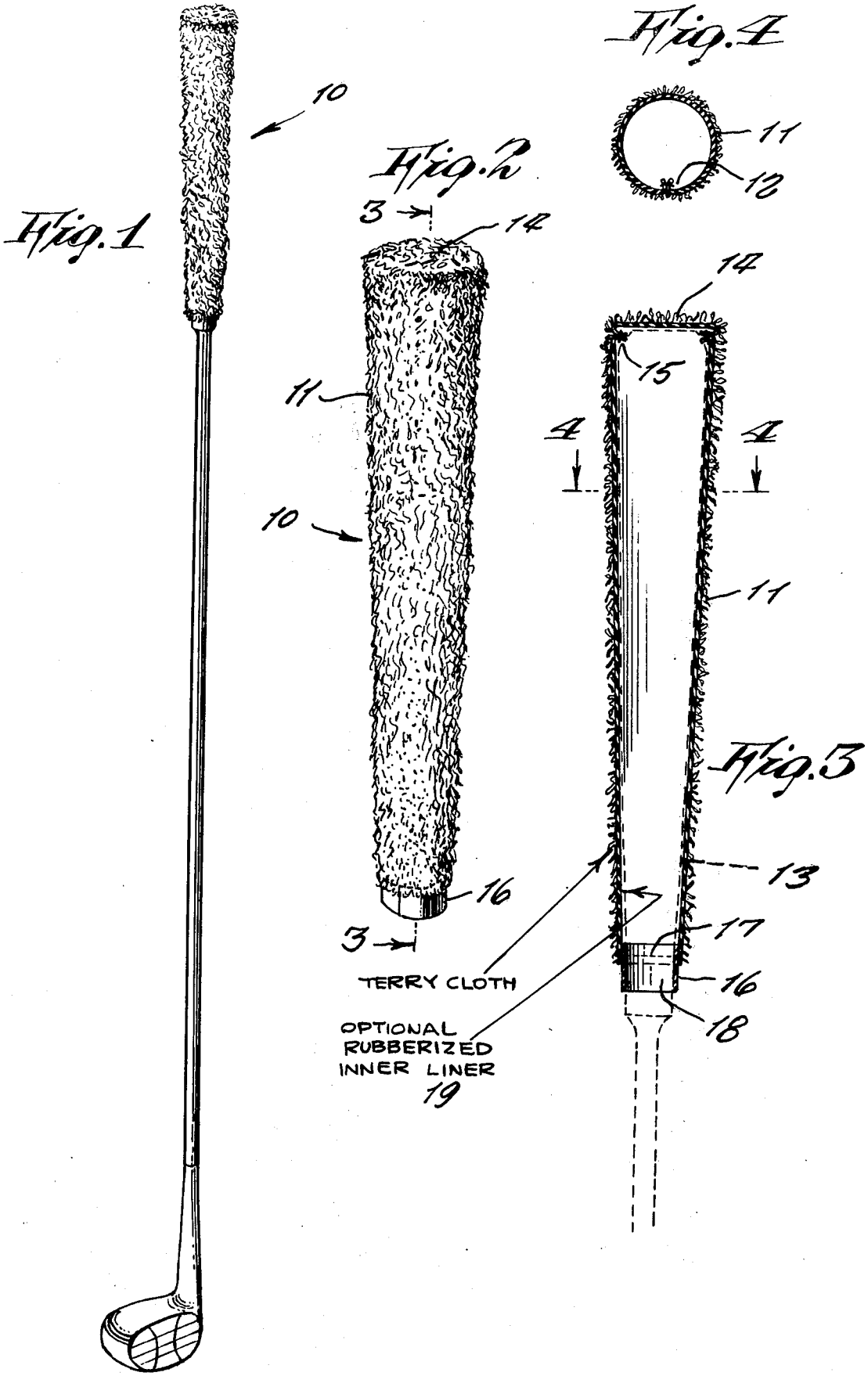
FIG. 1 is a perspective view of the invention installed on a handle of a golf club.
FIG. 2 is a perspective view of the invention shown alone.
FIG. 3 is a cross sectional view taken on line 3—3 of FIG. 2.
FIG. 4 is a transverse cross sectional view taken on line 4—4 of FIG. 3.

Referring now to the drawings in greater detail, the reference numeral 10 represents a golf grip according to the present invention, wherein there is a sleeve 11 made of terrycloth, having its soft strands of fibers extending outwardly. The sleeve is sewn with a stitching 12 into a shape so to snugly fit around a handle 13 of a golf club, and is of a length so that both hands of a players can be fitted there around. The upper end of the sleeve has a circular pad 14 attached thereto by stitching 15. The pad is also made of terrycloth with soft fiber strands extending outwardly. The pad rests against the upper end of the golf club handle.

A plastic collar 16, secured by stitching 17 around a lower end of the sleeve, includes an adhesive 18 or other securing means on its inner side in order to hold firmly against the surface of the golf club handle.

In operative use, the golf grip is simply slid over the handle of the golf club, and the collar is then firmly adhered to the handle surface which should first be cleaned of any existing perspiration so as to form a tight bond. In use, a player will find the golf grip more comfortable to hold. When the golf grip becomes soiled from use, it can be readily be removed and machine washed before being replaced on the handle for further continued use.

In a modified design of the invention, a rubberized inner liner 19 may be applied to the inner side of the terrycloth as an optional feature, as preferred by a manufacturer. Such liner may be advantageous for a greater frictional grasp of the club handle.

A second additional method of fabricating the golf grip is that stitching 12 and 15 can be omitted and the entire sleeve 11 with circular pad 14 can be woven as a single piece on a loom or similar machine in much the same way that a seamless stocking is fabricated.

While certain novel features of this invention have been shown and described, and are pointed out in the annexed claims, it will be understood that various omissions, substitutions and changes in the forms and details of the device illustrated and in its operation can be made by those skilled in the art without departing from the spirit of the invention.

What is claimed is:

1. A golf grip for fitting around a handle of a golf club, including in combination, an elongated sleeve having a closed upper end consisting of terry cloth material, said sleeve being shaped to suit a shape of a golf club and being sufficiently long for both hands of a player to hold thereagainst, a plastic collar stitched within a lower end of said terry cloth material, and adhesvie material formed on the inner side of said collar for securing said sleeve onto said golf club handle.

2. The combination as set forth in claim 1, and further comprising a rubberized inner liner bonded to an inner side of said elongated sleeve, and wherein said plastic collar is stitched to said terry cloth material.

3. The combination as set forth in claim 2 wherein said sleeve is sewn longitudinally into its shape and includes a pad of terry cloth material stitched at said upper end.

4. The combination as set forth in claim 1 wherein said sleeve is woven as a single seamless piece.

* * * * *